US009010461B2

(12) United States Patent
Hay

(10) Patent No.: US 9,010,461 B2
(45) Date of Patent: Apr. 21, 2015

(54) GUIDE WIRE FOR RANGING AND SUBSURFACE BROADCAST TELEMETRY

(75) Inventor: Richard T. Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 64 days.

(21) Appl. No.: 13/055,852

(22) PCT Filed: Jun. 1, 2009

(86) PCT No.: PCT/US2009/045773

§ 371 (c)(1),
(2), (4) Date: Jan. 25, 2011

(87) PCT Pub. No.: WO2010/141004

PCT Pub. Date: Dec. 9, 2010

(65) Prior Publication Data

US 2012/0061143 A1 Mar. 15, 2012

(51) Int. Cl.

| | |
|---|---|
| ***E21B 7/00*** | (2006.01) |
| ***E21B 47/022*** | (2012.01) |
| ***E21B 47/12*** | (2012.01) |

(52) U.S. Cl.

CPC ..... *E21B 47/02216* (2013.01); *E21B 47/122* (2013.01)

USPC ..... 175/57; 175/40; 175/45; 175/62; 166/250.01; 340/854.3

(58) Field of Classification Search

USPC ..... 175/57, 40, 45, 62; 166/250.01; 340/853.1, 854.1, 854.3

See application file for complete search history.

(56) References Cited

U.S. PATENT DOCUMENTS

| | | | |
|---|---|---|---|
| 407,220 | A | 7/1889 | King |
| 2,183,565 | A | 12/1939 | Hawley |
| 3,350,634 | A | 10/1967 | Hoehn, Jr. |
| 3,406,766 | A | 10/1968 | Henderson |
| 3,731,752 | A | 5/1973 | Schad |

(Continued)

FOREIGN PATENT DOCUMENTS

| | | |
|---|---|---|
| WO | WO-2009151867 | 12/2009 |
| WO | WO-2011019340 | 2/2011 |

OTHER PUBLICATIONS

GE Energy, "Magrange III—Your Shortcut to Blowout Well Control", GE Energy—Oil & Gas Solutions, gepower.com/oilexploration, Twinburg, OH, (Oct. 2004), 4 pgs.

(Continued)

*Primary Examiner* — David Bagnell
*Assistant Examiner* — Taras P Bemko
(74) *Attorney, Agent, or Firm* — Krueger Iselin LLP; Alan Bryson

(57) ABSTRACT

A managed bulk drilling system that employs a guide wire for ranging and crosswell telemetry. Some system embodiments include multiple drilling assemblies operating in the vicinity of a reference well that contains an electrical cable. The electrical cable is coupled to a surface control system. The control system uses the electrical cable as part of an antenna to receive uplink signals from the drilling assemblies and to broadcast down-link signals to the drilling assemblies. The uplink signals can include position data and the downlink signals can include individual steering commands to adjust the trajectories of each drilling assembly. The cable can also generate a guidance field for the drilling assemblies to detect and follow.

22 Claims, 3 Drawing Sheets

(56) References Cited

U.S. PATENT DOCUMENTS

| | | | | |
|---|---|---|---|---|
| 3,745,446 | A | 7/1973 | Norris | |
| 3,967,201 | A | 6/1976 | Rorden | |
| 4,323,848 | A | 4/1982 | Kuckes | |
| 4,458,767 | A | 7/1984 | Hoehn, Jr. | |
| 4,529,939 | A | 7/1985 | Kuckes | |
| 4,590,593 | A | 5/1986 | Rodney | |
| 4,593,770 | A | 6/1986 | Hoehn, Jr. | |
| 4,675,488 | A | 6/1987 | Mucha et al. | |
| 4,700,142 | A | 10/1987 | Kuckes | |
| 4,791,373 | A | 12/1988 | Kuckes | |
| 4,933,640 | A | 6/1990 | Kuckes | |
| 4,980,642 | A | 12/1990 | Rodney | |
| 5,074,365 | A | 12/1991 | Kuckes | |
| 5,138,313 | A | 8/1992 | Barrington | |
| 5,218,301 | A | 6/1993 | Kuckes | |
| 5,305,212 | A | 4/1994 | Kuckes | |
| 5,485,089 | A | 1/1996 | Kuckes | |
| 5,515,931 | A | 5/1996 | Kuckes | |
| 5,541,517 | A | 7/1996 | Hartmann | |
| 5,589,775 | A * | 12/1996 | Kuckes | 324/346 |
| 5,657,826 | A | 8/1997 | Kuckes | |
| 5,675,488 | A | 10/1997 | McElhinney | |
| 5,725,059 | A | 3/1998 | Kuckes et al. | |
| 5,886,303 | A | 3/1999 | Rodney | |
| RE36,569 | E | 2/2000 | Kuckes | |
| 6,075,462 | A | 6/2000 | Smith | |
| 6,098,727 | A | 8/2000 | Ringgenberg et al. | |
| 6,160,492 | A | 12/2000 | Herman | |
| 6,257,334 | B1 | 7/2001 | Cyr | |
| 6,439,324 | B1 | 8/2002 | Ringgenberg et al. | |
| 6,466,020 | B2 | 10/2002 | Kuckes et al. | |
| 6,630,890 | B1 | 10/2003 | Endo et al. | |
| 6,657,597 | B2 | 12/2003 | Rodney et al. | |
| 6,736,222 | B2 | 5/2004 | Kuckes et al. | |
| 6,750,783 | B2 | 6/2004 | Rodney | |
| 6,791,469 | B1 | 9/2004 | Rao et al. | |
| 7,017,662 | B2 | 3/2006 | Schultz et al. | |
| 7,084,782 | B2 | 8/2006 | Davies et al. | |
| 7,188,689 | B2 | 3/2007 | Maxwell et al. | |
| 7,212,132 | B2 | 5/2007 | Gao et al. | |
| 7,219,747 | B2 | 5/2007 | Gleitman et al. | |
| 7,219,748 | B2 | 5/2007 | Gao et al. | |
| 7,287,603 | B2 | 10/2007 | Hay et al. | |
| 7,301,223 | B2 | 11/2007 | Rodney et al. | |
| 7,336,199 | B2 | 2/2008 | Lasater et al. | |
| 7,407,020 | B2 | 8/2008 | Gleitman et al. | |
| 7,413,034 | B2 | 8/2008 | Kirkhope et al. | |
| 7,505,242 | B2 | 3/2009 | Gullich | |
| 7,650,269 | B2 | 1/2010 | Rodney | |
| 7,668,583 | B2 | 2/2010 | Fegert et al. | |
| 7,686,099 | B2 | 3/2010 | Rodney et al. | |
| 7,743,654 | B2 | 6/2010 | Spross et al. | |
| 7,757,781 | B2 | 7/2010 | Hay et al. | |
| 8,170,851 | B2 | 5/2012 | Rodney | |
| 2002/0105332 | A1 | 8/2002 | Rosthal et al. | |
| 2002/0113592 | A1 | 8/2002 | Omeragic | |
| 2003/0117134 | A1 | 6/2003 | Almaguer | |
| 2003/0184303 | A1 | 10/2003 | Homan et al. | |
| 2004/0119476 | A1 | 6/2004 | Homan et al. | |
| 2004/0249573 | A1 | 12/2004 | McElhinney | |
| 2005/0156602 | A1 | 7/2005 | Conti | |
| 2005/0168225 | A1 | 8/2005 | Haber et al. | |
| 2005/0173119 | A1 | 8/2005 | Hay et al. | |
| 2005/0288576 | A1 | 12/2005 | Fegert et al. | |
| 2006/0036376 | A1 | 2/2006 | Gudmundsson et al. | |
| 2007/0126426 | A1 | 6/2007 | Clark et al. | |
| 2007/0278008 | A1 | 12/2007 | Kuckes et al. | |
| 2008/0018334 | A1 | 1/2008 | Reiderman | |
| 2008/0041626 | A1 | 2/2008 | Clark | |
| 2009/0030615 | A1 | 1/2009 | Clark | |
| 2009/0164127 | A1 | 6/2009 | Clark | |
| 2010/0108383 | A1 | 5/2010 | Hay et al. | |
| 2010/0219646 | A1 | 9/2010 | Hay et al. | |
| 2011/0153217 | A1 | 6/2011 | Rodney | |
| 2011/0175899 | A1 | 7/2011 | Bittar et al. | |
| 2012/0126993 | A1 | 5/2012 | Samson et al. | |
| 2012/0158305 | A1 | 6/2012 | Rodney et al. | |
| 2012/0162631 | A1 | 6/2012 | Hutchin | |
| 2014/0035586 | A1 | 2/2014 | Rodney | |
| 2015/0002306 | A1 | 1/2015 | Hay et al. | |

OTHER PUBLICATIONS

Halliburton Energy Services, Inc, "Sperry Drilling Services Active Magnetic Ranging System", www@halliburton.com, H05637, (Jun. 2008), 2 pgs.

Hay, Richard T. "Borehole Array for Ranging and Crosswell Telemetry", Application No. PCT/US09/49470, filed Jul. 2, 2009, 16 pgs.

PCT Internat'l Search Report and Written Opinion, dated Sep. 9, 2009, Appl No. PCT/US09/49470, "Borehole Array for Ranging and Crosswell Telemetry", filed Jul. 2, 2009 10 pgs.

PCT Internat'l Search Report and Written Opinion, dated Jul. 20, 2009, Appl No. PCT/US2009/045773, "Guide Wire for Ranging and Sub-Surface Broadcast Telemetry", filed Jun. 1, 2009, 7 pgs.

Gardner, Wallace R., et al., "Downhole Telemetry System Using Discrete Multi-Tone Modulation in a Wireless Communication Medium", U.S. Appl. No. 10/364,169, filed Feb. 10, 2003, 25 pgs.

Gladiator Technologies, "New Low Noise Verion of G507 MEMS Gyro", http://www.gladiatortechnologies.com/NEWS/pressRoom_New . . . , G50Z "LN Series" (Low Noise) Enables Demanding Stabilization Applications a Low Cost, Light Weight and VSG Compatible Alternative,(Sep. 21, 2009),1 pg.

Rodney, Paul F., et al., "Systems and Methods for Displaying Logging Data", U.S. Appl. No. 12/295,158, filed Sep. 29, 2008, 16 pgs.

Wikipedia, "Lock-in amplifier", Wikipedia, http://en.wikipedia.org/wiki/Lock-in_amplifier, (Mar. 25, 2011), 6 pgs.

Williamson, Hugh S., "Accuracy Prediction for Directional MWD", SPE 56702, presented at the 1999 SPE Annual Technical Conference and Exhibition held in Houston, TX Oct. 3-6, 1999, 16 pgs.

PCT International Preliminary Report on Patentability, dated Dec. 15, 2011, Appl No. PCT/US2009/045773, "Guide Wire for Ranging and Sub-Surface Broadcast Telemetry", filed Jun. 1, 2009, 7 pgs.

PCT International Preliminary Report on Patentability, dated Jan. 12, 2012, Appl No. PCT/US09/49470, "Borehole Array for Ranging and Crosswell Telemetry", filed Jul. 2, 2009, 7 pgs.

Rodney, Paul F., "Systems and Methods for Ranging While Drilling", U.S. Appl. No. 13/577,329, filed Mar. 31, 2011, 33 pgs.

US Non-Final Office Action, dated Jan. 2, 2013, U.S. Appl. No. 13/056,661, "Borehole Array for Ranging and Crosswell Telemetry", filed Jan. 30, 2011, 12 pgs.

US Final Office Action, dated Jun. 14, 2013, U.S. Appl. No. 13/056,661, "Borehole Array for Ranging and Crosswell Telemetry", filed Jul. 2, 2009, 16 pgs.

PCT International Preliminary Report on Patentability, dated Oct. 10, 2013, Appl. No. PCT/US2011/030639, "Systems and Methods for Ranging While Drilling", filed May 31, 2011, 7 pgs.

US Non-Final Office Action, dated Aug. 14, 2014, U.S. Appl. No. 13/577,329, "Systems and Methods for Ranging While Drilling," filed Aug. 6, 2012, 16 pgs.

US Final Office Action, dated Dec. 4, 2014, U.S. Appl. No. 13/577,329, "Systems and Methods for Ranging While Drilling," Filed Aug. 6, 2012, 16 pgs.

US Non-Final Office Action, dated Feb. 11, 2015, U.S. Appl. No. 14/488,170, "Borehole Array for Ranging and Crosswell Telemetry", filed Sep. 16, 2014, 13 pgs.

* cited by examiner

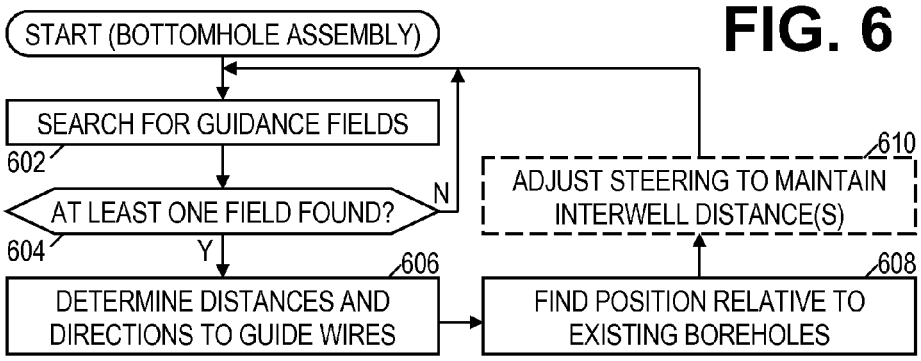
FIG. 6
START (BOTTOMHOLE ASSEMBLY)
SEARCH FOR GUIDANCE FIELDS
602
AT LEAST ONE FIELD FOUND?
N
604
Y
606
DETERMINE DISTANCES AND DIRECTIONS TO GUIDE WIRES
608
FIND POSITION RELATIVE TO EXISTING BOREHOLES
610
ADJUST STEERING TO MAINTAIN INTERWELL DISTANCE(S)

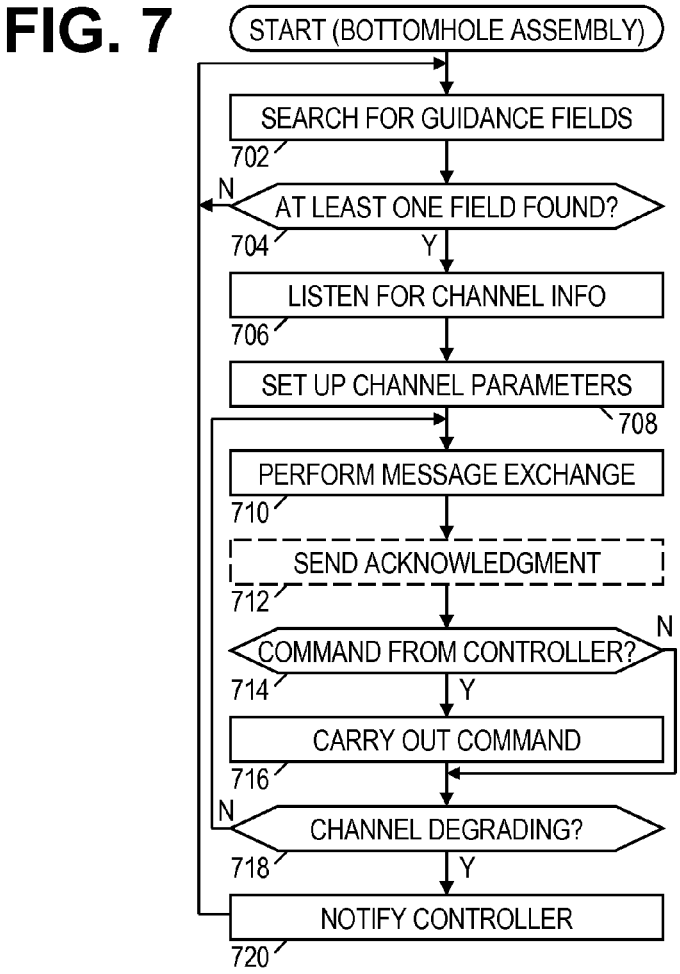
FIG. 7
START (BOTTOMHOLE ASSEMBLY)
SEARCH FOR GUIDANCE FIELDS
702
N
AT LEAST ONE FIELD FOUND?
704
Y
LISTEN FOR CHANNEL INFO
706
SET UP CHANNEL PARAMETERS
708
PERFORM MESSAGE EXCHANGE
710
SEND ACKNOWLEDGMENT
712
N
COMMAND FROM CONTROLLER?
714
Y
CARRY OUT COMMAND
716
N
CHANNEL DEGRADING?
718
Y
NOTIFY CONTROLLER
720

GUIDE WIRE FOR RANGING AND SUBSURFACE BROADCAST TELEMETRY

BACKGROUND

The world depends on hydrocarbons to solve many of its energy needs. Consequently, oil field operators strive to produce and sell hydrocarbons as efficiently as possible. Much of the easily obtainable oil has already been produced, so new techniques are being developed to extract less accessible hydrocarbons. One such technique is steam-assisted gravity drainage ("SAGD") as described in U.S. Pat. No. 6,257,334, "Steam-Assisted Gravity Drainage Heavy Oil Recovery Process". SAGD uses pairs of vertically-spaced, horizontal wells less than about 10 meters apart.

In operation, the upper wells are used to inject steam into the formation. The steam heats the heavy oil, thereby increasing its mobility. The warm oil (and condensed steam) drains into the lower wells and flows to the surface. A throttling technique is used to keep the lower wells fully immersed in liquid, thereby "trapping" the steam in the formation. If the liquid level falls too low, the steam flows directly from an upper well to a lower well, reducing the heating efficiency and inhibiting production of the heavy oil. Such a direct flow (termed a "short circuit") greatly reduces the pressure gradient that drives fluid into the lower wells.

Short circuit vulnerability can be reduced by carefully controlling the inter-well spacing. (Points where the inter-well spacing is too small will provide lower resistance to short circuit flows.) In the absence of precision drilling techniques, drillers are forced to employ larger inter-well spacings than would otherwise be desirable, so as to reduce the effects of inter-well spacing variances. Precision placement of neighboring wells is also important in other applications, such as collision avoidance, infill drilling, observation well placement, coal bed methane degasification, and wellbore intersections for well control.

BRIEF DESCRIPTION OF THE DRAWINGS

A better understanding of the various disclosed embodiments can be obtained when the detailed description is considered in conjunction with the drawings, in which:

FIG. 6 shows an illustrative guidance method that can be implemented by a drilling assembly; and FIG. 7 shows an illustrative communication method that can be implemented by a drilling assembly.

Figure 1:
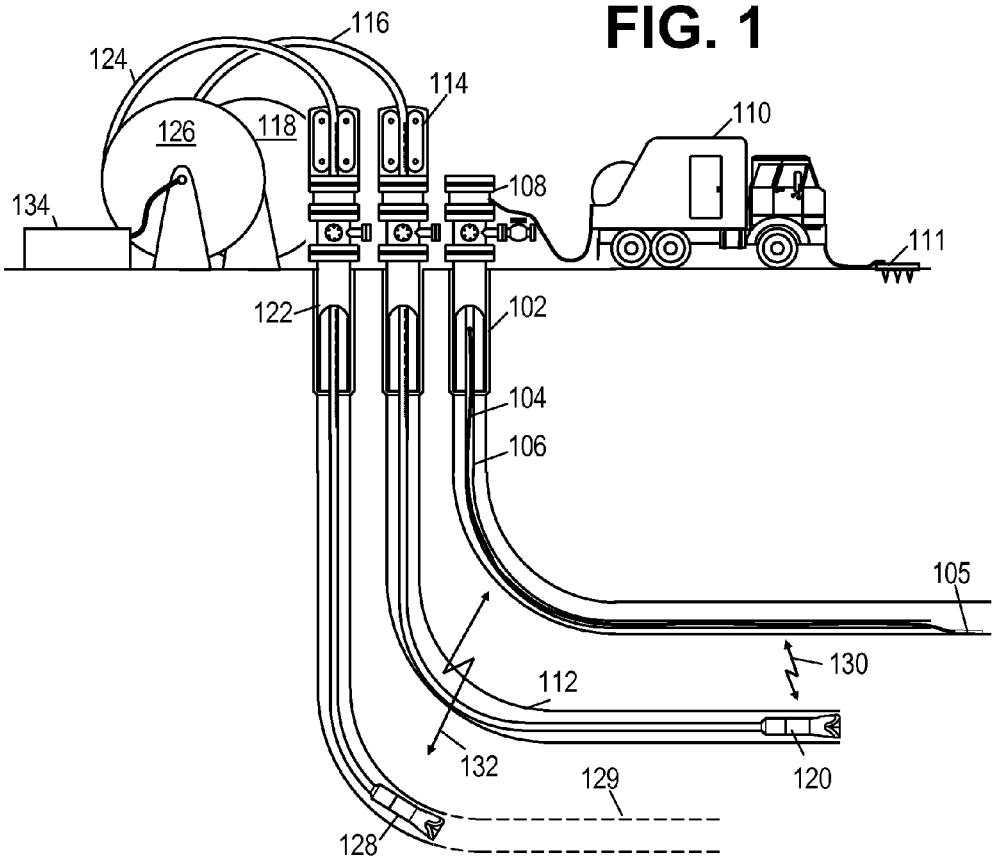
FIG. 1 shows an illustrative guide wire being used to concurrently guide multiple drilling assemblies.

While the invention is susceptible to various modifications and alternative forms, specific embodiments thereof are shown by way of example in the drawings and will herein be described in detail. It should be understood, however, that the drawings and detailed description thereto are not intended to limit the disclosed embodiments, but on the contrary, the intention is to cover all modifications, equivalents and alternatives falling within the scope of the appended claims.

DETAILED DESCRIPTION

The problems identified in the background are at least partly addressed by a managed bulk drilling system that employs a guide wire for ranging and crosswell telemetry. Some system embodiments include multiple drilling assemblies operating in the vicinity of a reference well that contains an electrical cable. The electrical cable is coupled to a surface control system. The control system uses the electrical cable as part of an antenna to receive uplink signals from the drilling assemblies and to broadcast downlink signals to the drilling assemblies. The uplink signals can include position data and the downlink signals can include individual steering commands to adjust the trajectories of each drilling assembly. The cable can also generate a guidance field for the drilling assemblies to detect and follow.

Some embodiments of the managed bulk drilling methods include: creating at least one reference well with an insulated electrical conduction path; concurrently drilling multiple target wells in the vicinity of the at least one reference well; and sensing signals on the conduction path to detect electromagnetic transmissions from drilling assemblies in the target wells. In at least some methods, a downlink signal is communicated on the conduction path to broadcast information to the drilling assemblies and/or to provide a guidance field for the drilling assemblies to use in determining a distance and range to the reference well. Multiple reference wells can be employed to increase the precision with which the drilling assemblies determine their position.

Such methods can be used to direct the drilling assembly along a path parallel to at least one of the reference wells. The magnetic fields produced by the different reference nodes can be made distinguishable using multiplexing techniques, e.g., frequency multiplexing, time multiplexing, and code division multiplexing. To determine distance and direction, the drilling assembly can determine a gradient of each magnetic field, or employ one of the other distance and direction sensing techniques invented by Arthur F. Kuckes and disclosed in his various issued patents.

Turning now to the figures, FIG. 1 shows a reference well 102 having an electrical conductor 104 passing through a string of composite tubing 106. In the illustrated embodiment, conductor 104 is an insulated electrical cable with the insulation removed from a stripped end 105 that lies in contact with the formation. The cable's stripped end 105 can be conveyed to the toe of the well using a weight bar and/or a "sail" that enables a fluid flow to carry the cable.

In any event, the intent is to provide a path for current flow along a substantial length of the reference well, and any conduction path that serves this purpose can be used. To maximize the range of electromagnetic fields generated by the current flow, it is desirable to avoid having the path for returning current confined to the reference well, but rather to have the current diffuse into the formation or perhaps return along a path that is well separated from the reference well. For this reason, any conductive borehole fluids or conductive tubing in the reference well 102 should be maintained at a shared potential or insulated from the formation. Alternatively, such fluids or tubing can be avoided when creating the reference well.

A well head 108 anchors the electrical conductor 104 and serves as a connection point for a control system such as a logging truck 110. A ground plate 111 is provided as an electrode for receiving a return current flow. In some embodiments, the well head of a well spaced away from the target wells (e.g., a vertical well near the toe of the reference well) can serve as a connection point for receiving return current.

FIG. 1 also shows a second well 112 in the process of being drilled. An injector 114 pulls a coil tubing string 116 from a spool 118 and drives it into a well. A drilling assembly 120 on the end of the string 116 includes a mud motor and a drill bit.

As drilling fluid is pumped through the string, out through orifices in the drill bit, and back up the annulus around the string, the fluid flow drives a mud motor which turns the drill bit. The fluid flow can also drive a generator to power downhole electronics such as: a telemetry module, one or more sensor modules, and a steering module (discussed further below).

Also shown in FIG. 1 is a third well 122 in the process of being drilled with a coil tubing string 124 drawn from a spool 126 and injected into the well bore. A drilling assembly 128 on the end of the string 124 includes various tool modules, a mud motor and a drill bit. The mud motor is driven by the drilling fluid flow, and in turn it drives the drill bit to extend the well bore along a desired path 129. Desired path 129 is shown as running parallel to the horizontal portions of wells 102 and 112 because in many cases, such as steam-assisted gravity drainage (SAGD) or coal bed degasification, it is desirable to drill a series of closely-spaced parallel wells. Moreover, many such wells may need to be drilled concurrently to complete the project in a reasonable amount of time.

Each of the drilling assemblies 120, 128 is equipped with a steering module that enables the well to be extended in a desired direction. Many suitable steering mechanisms are well known, e.g., steering vanes, "bent sub" assemblies, and rotary steerable systems. The steering mechanism configuration can be set and adjusted by commands from the surface, e.g., from logging truck 110 or from a driller's control panel 134. Either control system can include a computer that executes software to interact with a user via a user interface (including a display). The software enables a user to view the data being gathered by the drilling assemblies and to responsively steer them in a desired direction. In some embodiments, the steering can be automated by the software. Alternatively, a downhole controller can be programmed with a desired route, and it can adjust the steering mechanism as needed to direct the well along the desired path. As new information becomes available, the user can send commands from the surface to reprogram the desired route being followed by the downhole controller.

Each of the drilling assemblies can be further equipped with a sensor module to determine the position of the drilling assembly relative to a desired path. The sensor module includes position sensing mechanisms such as gyroscopes, multi-component accelerometers, and/or magnetometers to detect inertial displacement and orientations relative to gravity and the earth's magnetic field. Moreover, the magnetometers are multi-component magnetometers for detecting the magnetic fields emitted by the electrical conductor 104 in the reference well(s), enabling the drilling assemblies to determine their position relative to the reference well(s), e.g., in accordance with one of the methods taught by Arthur Kuckes in U.S. Pat. Nos. 4,933,640; 5,074,365; 5,218,301; 5,305,212; 5,515,931; 5,657,826; and 5,725,059. In some alternative embodiments, the reference wells emit electrical fields that can be sensed by the drilling assemblies.

The drilling assemblies each further include a telemetry module that enables the drilling assembly to exchange electromagnetic inter-well communications with the control facility via the electrical conductor 104. Thus in FIG. 1, an arrow 130 indicates electromagnetic communications between electrical conductor 104 and drilling assembly 120, while a second arrow 132 indicates electromagnetic communications between electrical conductor 104 and drilling assembly 128. Depending on the reference well geometry and electrical properties of the formation, the communications range is expected to be at least 30 meters and possibly up to 300 meters from the electrical conductor 104. Nevertheless, the telemetry module may also support conventional telemetry via the drill string as a backup communications technique, e.g., mud pulse telemetry, through-wall acoustic communications, or wired drill pipe telemetry. Low frequency electromagnetic signaling directly to the surface is another potential backup communications technique.

Figure 2:
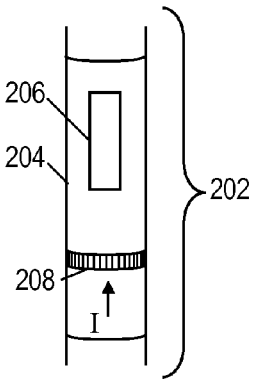
FIG. 2 shows an illustrative guidance module for a drilling assembly.

FIG. 2 shows an illustrative portion of a drilling assembly 202 having a guidance module 204. The guidance module 204 may take the form of a drilling collar, and is preferably constructed from a very low relative magnetic permeability material (preferably with a relative permeability less than 1.01) to enable magnetometers in electronics 206 to measure characteristics of electromagnetic fields radiated from one or more reference wells. The electromagnetic fields may vary in a manner characteristic to each reference well to enable the guidance module to compensate for interference from any other sources including the earth's magnetic field. The magnetometers may measure the magnetic field gradient to determine distance and direction to each reference well. Periodically, this information can be transmitted by a toroid 208 that induces a current flow in the drilling string. The resulting electrical field induces a signal in electrical conductor 104, which conveys the signal to the control facility. Conversely, currents in the electrical conductor 104 induce drilling assembly currents which can be detected by toroid 208, enabling two-way communication to occur between each drilling assembly and the control facility.

Each communication to the control facility includes some identification of the drilling assembly that sent it. This identification can be an ID value in a predetermined field, or it can be some characteristic of the message such as the frequency or channel upon which the message is sent. Similarly, because each message from the control facility is broadcast to the drilling assemblies, such messages include some identification of the intended target for that message. As before, it can be an ID value or some characteristic of the message itself.

The toroid 208 can be replaced with a nonconductive gap, across which voltage sensing is performed. Electrically, such a configuration behaves similarly to the toroid, but mechanically it is quite different. Where strength and rigidity are desired, the toroid configuration is preferred. While the toroid 208 or nonconductive electrical gap can be used for both transmitting and receiving, some alternative embodiments will employ the magnetometers to receive communications that are modulated onto the magnetic field emanated by the electrical conductor 104. Often the magnetometer arrangement will be tri-axial, e.g., it will employ three orthogonal magnetic field sensors. The output of these magnetic field sensors can be combined in a manner that synthesizes an optimally-oriented virtual sensor so as to obtain a maximum gain for receiving the communicated signals. An internal processor can then demodulate the signals to extract commands and other downlink data.

Figure 3:
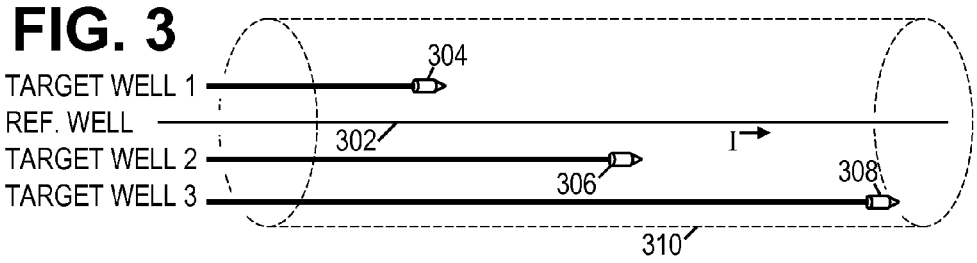
FIG. 3 illustrates the use of a guide wire to communicate with multiple drilling assemblies.

FIG. 3 shows an illustrative guide wire 302 carrying a current I in a reference well. As drilling assemblies 304-308 create nearby target wells parallel to the reference well, the drilling assemblies operate within a guidance field 310 generated by the guide wire 302. The guide wire current alternates in polarity, enabling the drilling assemblies to determine and maintain the relative distance and direction to the reference well. Moreover, the guide wire 302 can serve as an antenna for exchanging messages with the multiple drilling assemblies.

Figure 4:
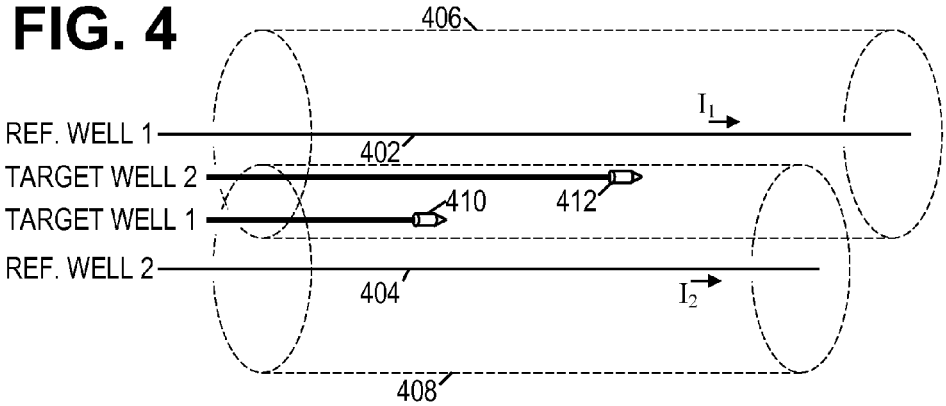
FIG. 4 illustrates the use of multiple guide wires to communicate with multiple drilling assemblies.

FIG. 4 shows two reference wells each having a guide wire 402, 404 to generate corresponding guidance fields 406, 408 with an overlapping region of coverage. Where such overlaps occur, adjacent reference wells employ a strategy to make their magnetic fields distinguishable by the drilling assembly. Suitable strategies include, without limitation, providing each well with a unique channel in a time division multiplexing (TDM), frequency division multiplexing (FDM), or code division multiplexing (CDM) scheme. Drilling assemblies 410, 412 operating within the overlapping region can use multiple reference wells to determine the position of the drilling assembly with increased precision. These strategies can also be used for message exchange between the reference wells and the drilling assemblies. Other potentially suitable signaling protocols employ packet-based signaling with automatic collision detection and re-transmission from drilling assemblies having unique addresses.

In some cases, detection signals from multiple reference wells are combined using antenna-array signal processing techniques to improve signal strength. Such processing potentially increases uplink channel capacity.

Figure 5:
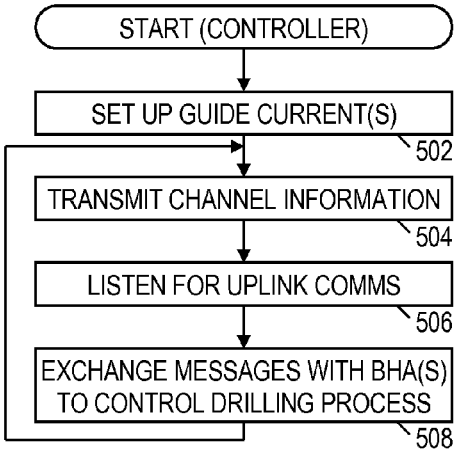
FIG. 5 shows an illustrative communication and guidance method that can be implemented by a system controller.

FIG. 5 shows an illustrative communication and guidance method that can be implemented by a surface-based controller of the downhole activity. Beginning in block 502, the controller sets up the reference well currents, specifying the amount of current and the alternation frequency, which preferably varies between reference wells and falls in the range below about 5 Hz. In block 504 the controller transmits so-called "beacon information" which is a broadcast of a synchronization signal accompanied by channel assignments, i.e., the channels that each of the drilling assemblies should use for sending and receiving communications. The beacon information and subsequent communications can be modulated signals in a higher frequency range (e.g., 10-100 Hz) which are added to the reference currents.

In block 506 the controller listens for uplink communications from drilling assemblies and extracts the transmitted information from such communications. Such information may include logging data, measured drilling parameters, signal level measurements, and position information. Based on the gathered information, along with any other available information (such as length of the drill pipe in the hole), the controller determines the position of each drilling assembly and in block 508 the controller exchanges messages with the drilling assemblies to control the drilling process. In some embodiments, the controller provides steering commands to the drilling assemblies, enabling a user to manage the drilling process from a central location. Blocks 504-508 are repeated until the drilling is complete.

FIG. 6 shows an illustrative guidance method that can be implemented by a drilling assembly. This guidance method runs concurrently with the communication method described below, and may be implemented within the guidance module. In block 602, the drilling assembly searches for reference well guidance fields, i.e., magnetic fields that alternate in a predetermined frequency range. In block 604, a check is made to determine whether at least one guidance field has been found, and if not, the method loops back to block 602.

Once at least guidance field has been detected, the drilling assembly determines the distances and directions to each of the detectable reference wells in block 606. Suitable methods for determining distance and direction are disclosed by Arthur Kuckes in U.S. Pat. Nos. 4,933,640; 5,074,365; 5,218,301; 5,305,212; 5,515,931; 5,657,826; and 5,725,059. The methods taught by Kuckes are described in terms of a single reference well, but they are adaptable for use with multiple reference wells by providing each reference well (or other guidance field generator) with a distinctive signature that enables individual measurement of each guidance field. As one example, the reference wells can be enabled only one at a time and cycled in a predetermined sequence. In an alternative embodiment, each of the reference wells reverses its magnetic field periodically with a frequency that is different from any other reference well. As yet another possible embodiment, the magnetic field generated by each reference well is modulated with a code that is orthogonal to the codes used by other nodes, e.g., in a fashion similar to a code-division multiple access (CDMA) system.

Whichever technique is chosen for making the magnetic fields distinctive allows the drilling assemblies to determine and monitor the gradient of each magnetic field. Given the change in gradient as a function of drilling assembly position, the distance and direction to the source of the magnetic field can be estimated. However, other methods for distance and direction determination can alternatively be employed, including monitoring travel times, and/or triangulating relative to multiple magnetic field sources.

In block 608, the drilling assembly determines its position relative to the reference boreholes based at least in part on the measured distances and directions to the guide wires. The drilling assembly can also employ displacement measurements and knowledge of the reference borehole geometry. This information can be transmitted to the surface facility or, in optional block 610, the information can be provided to the steering module for use in keeping the drilling assembly on its programmed track. The method repeats as the drilling assembly moves, enabling the drilling assembly to track its position.

FIG. 7 shows an illustrative communication method that can be implemented by a drilling assembly. Once the method is initiated, the guidance module in drilling assembly begins searching for guidance fields in block 702. In block 704 the module checks to determine if a guidance field has been found, and if not, the module loops back to block 702. Once one or more guidance fields have been found, the guidance module reaches block 706, where it listens for beacon information to determine channel assignments and synchronization timing. In block 708, the guidance module sets up the communication channel parameters to create a bi-directional communications channel.

In block 710, the guidance module performs a message exchange with the control facility via the reference well(s). The message exchange includes transmitting message packets with any data that the drilling assembly is configured to acquire and transmit to the surface. Such data can include information regarding the position and velocity of the drilling assembly, formation properties that have been logged, and performance characteristics of the drilling assembly.

The message exchange further includes receiving any commands that might have been sent by the control facility. If any such commands are received, the receipt of such commands is optionally acknowledged in block 712. In block 714, the guidance module checks the receive queue to determine if any of the received messages include a command from the control facility. If so, the telemetry module carries out the command in block 716. Such commands can include commands to change the configuration or operating parameters of the drilling assembly. Other illustrative commands are commands to have selected data or parameter values transmitted to the surface.

In block 718, the guidance module checks the quality of the electromagnetic communications link. If the channel is degrading (e.g., the signal-to-noise ratio is below a given threshold, or too many symbol errors are detected), the module transmits a notification message to close the channel in block 720 and loops back to block 702. Otherwise the guidance module loops back to block 710 to perform another message exchange.

Numerous variations and modifications will be apparent to those of ordinary skill in the art once the above disclosure is fully appreciated. It is intended that the following claims be interpreted to embrace all such variations and modifications. As one example, rather than using the guidance field to provide a series of parallel well bores, the guidance fields can be used to track relative positions of converging or diverging boreholes.

What is claimed is:

1. A downhole telemetry method that comprises:

providing at least one reference well having an insulated conductor;

using the insulated conductor to electromagnetically broadcast signal that communicates downlink information from a surface facility to a plurality of drilling downhole tools in other wells; and communicating uplink information, comprising data acquired by the plurality of drilling downhole tools, from the plurality of drilling downhole tools to the surface facility via the insulated conductor.

2. The method of claim 1, wherein said using comprises supplying a signal current to the insulated conductor to generate the broadcast signal.

3. The method of claim 2, wherein said broadcast signal identifies a communication channel for each drilling downhole tool to use when communicating with the surface facility.

4. The method of claim 1, wherein said using comprises sensing a signal on the insulated conductor to receive a telemetry signal from each of said plurality of drilling downhole tools.

5. The method of claim 4, wherein at least one of the telemetry signals includes relative position information for a drilling assembly.

6. The method of claim 5, wherein said insulated conductor carries a current that generates a guidance field, and wherein said drilling assembly determines the relative position information based at least in part on measurements of the guidance field.

7. The method of claim 6, further comprising supplying a current to a second insulated conductor to generate a guidance field around another reference well, wherein said drilling assembly determines the relative position information based at least in part on measurements of the guidance field generated by the second insulated conductor.

8. The method of claim 1, wherein the uplink information includes an identification of the downhole tool or wellbore communicating the uplink information.

9. A downhole telemetry method that comprises:

providing at least one reference well having an insulated conductor;

using the insulate conductor to send an electromagnetic broadcast signal that communicates downlink information from a surface facility to a plurality of downhole tools in other wells; and communicating uplink information from the plurality of downhole tools to the surface facility via the insulated conductor;

wherein said using comprises supplying a signal current to the insulated conductor to generate the broadcast signal; and wherein said broadcast signal provides steering information to at least one of said downhole tools.

10. The method of claim 9, wherein said steering information is provided to direct the drilling assembly along a path parallel to the reference well.

11. A managed bulk drilling method that comprises:

creating at least one reference well with an insulated electrical conduction path;

concurrently drilling a plurality of target wells in the vicinity of the at least one reference well; and transmitting electromagnetic uplink signals sensed on the conduction path from drilling assemblies in the target wells to the surface facility;

wherein the uplink signals comprise data acquired by the drilling assemblies.

12. The method of claim 11, further comprising demodulating the signals to receive formation logging data from the drilling assemblies.

13. The method of claim 11, further comprising demodulating the signals to receive position information from the drilling assemblies.

14. The method of claim 13, further comprising transmitting a downlink signal via the communication path to individually steer the drilling assemblies.

15. The method of claim 13, further comprising passing a current along the conduction path to provide a guidance field for the drilling assemblies.

16. The method of claim 11, further comprising transmitting a downlink signal via the communication path to adjust operating parameters of the drilling assemblies.

17. The method of claim 11, further comprising passing a current along the conduction path to provide a guidance field for the drilling assemblies.

18. The method of claim 17, further comprising passing a current along a second reference well to provide a guidance field for the drilling assemblies.

19. A managed bulk drilling system that comprises:

a plurality of drilling assemblies operating to create a plurality of boreholes in the vicinity of a reference well;

an electrical cable positioned in the reference well; and a control system coupled to the electrical cable to receive an uplink signal, comprising data aquired by the plurality of drilling assemblies, from each of the plurality of drilling assemblies, wherein the control system broadcasts a downlink signal to the plurality of drilling assemblies via the electrical cable.

20. The system of claim 19, wherein the uplink signals include position information from each of the drilling assemblies, and the downlink signal includes individual steering commands for each of the drilling assemblies.

21. The system of claim 19, wherein the electrical cable generates a guide field for the plurality of drilling assemblies.

22. The system of claim 21, wherein each of the drilling assemblies includes a toroid for electromagnetic communications via the electrical cable.

* * * * *